US006960127B1

(12) United States Patent
Curen

(10) Patent No.: US 6,960,127 B1
(45) Date of Patent: Nov. 1, 2005

(54) STEREO HOLDING REFRIGERATOR

(76) Inventor: Christopher John Curen, 143 Pinetree Rd., Ithaca, NY (US) 14850

( * ) Notice: Subject to any disclaimer, the term of this patent is extended or adjusted under 35 U.S.C. 154(b) by 14 days.

(21) Appl. No.: 10/273,547

(22) Filed: Oct. 18, 2002

(51) Int. Cl.[7] ..... H05K 5/00
(52) U.S. Cl. ..... 454/184; 62/331; 62/259.2
(58) Field of Search ..... 454/187, 184; 62/331, 259.2

(56) References Cited

U.S. PATENT DOCUMENTS 5,070,755 A * 12/1991 Carroll ..... 84/600
5,979,175 A * 11/1999 Ellison ..... 62/457.7
6,400,566 B1 * 6/2002 Ootori ..... 361/695
6,497,110 B2 * 12/2002 Davidson et al. ..... 62/259.2

OTHER PUBLICATIONS

An internet article entitled "Born Again, Cold Storage". Written by Jennifer Darr. Found Nov. 5, 2002.

* cited by examiner

*Primary Examiner*—Derek Boles
(74) *Attorney, Agent, or Firm*—John Russell Uren

(57) ABSTRACT

A discarded refrigerator is used to hold electronic music playing equipment. The refrigerator has a door which can be opened or closed and is adapted to allow air to enter the interior of the refrigerator under pressure so as to cool the electronic equipment within the refrigerator during the operation of such equipment.

16 Claims, 5 Drawing Sheets

STEREO HOLDING REFRIGERATOR

This invention relates to a refrigerator and, more particularly, to a refrigerator which can be used for holding a stereo or high fidelity sound system.

BACKGROUND OF THE INVENTION

There are many used and discarded refrigerators available for recycling or other uses. The refrigerators are, for the most part, filled with freon or other refrigerant type fluids which are environmentally unfriendly and which still remain in the refrigerator. Such discarded refrigerators, while generally mechanically unsound, are cosmetically unscathed.

Old and discarded refrigerators are heavy and difficult to move. They are usually not in working condition and, until the advent of the present invention, there were relatively few uses for such refrigerators. Accordingly, they have remained in state of disrepair and contaminated the landscape.

Recently, the appearance of old refrigerators has become popular and such refrigerators have taken on additional attention. The "retro" look of such refrigerators has been commented on and found attractive by many. However, since most discarded and old refrigerators are not functional, they are not used since restoration is expensive. Replacement parts for old refrigerators may not be readily available. This has resulted in new refrigerators being produced with the look of old refrigerators while old discarded refrigerators remain in the discarded state.

SUMMARY OF THE INVENTION

According to one aspect of the invention, there is provided a refrigerator having a door operable to open and close, a storage area for holding and allowing the operation of music playing electronic apparatuses and a fan operable to cool said musical playing electronic apparatuses during said operation.

According to a further aspect of the invention, there is provided a method of playing music from an electronic music player within a refrigerator having a door operable to be opened and closed, said method comprising initiating operation of said electronic music player within said refrigerator and cooling said electronic music player during said operation of said electronic music player within said refrigerator.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
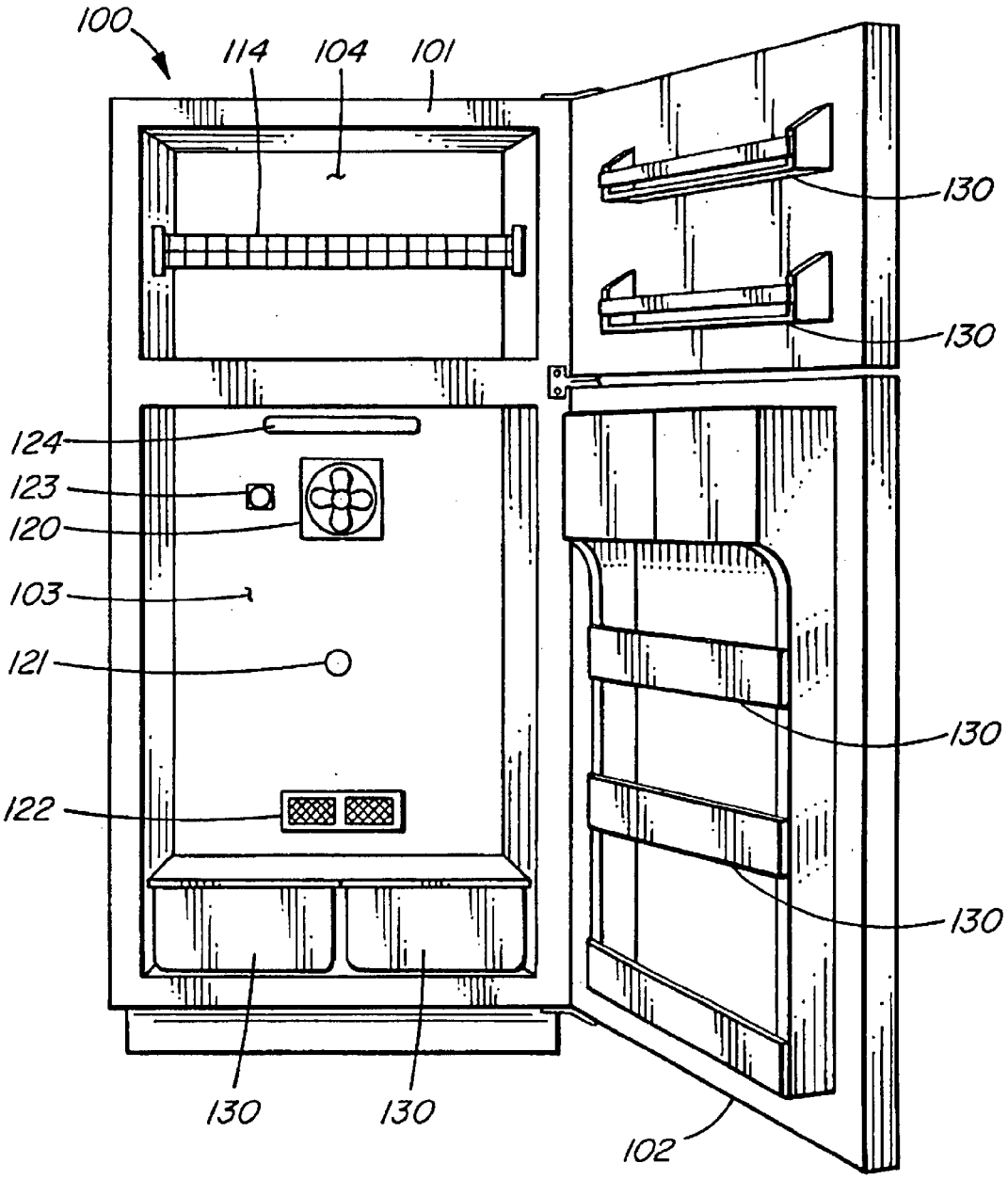
FIG. 1 is a diagrammatic isometric front view of a typical and previously discarded refrigerator used to hold the music player but shown without the music player for ease of description.

Referring now to the drawings, a refrigerator of the type generally used in the past and previously discarded is illustrated generally at 100 in FIG. 1. It comprises a body generally illustrated at 101 and a door 102 which door will open and close as is usual. A refrigerator storage unit previously used to hold food items at relatively higher temperatures is generally illustrated at 103 and an icebox previously used to hold food items at lower temperatures is generally illustrated at 104.

Figure 4A:
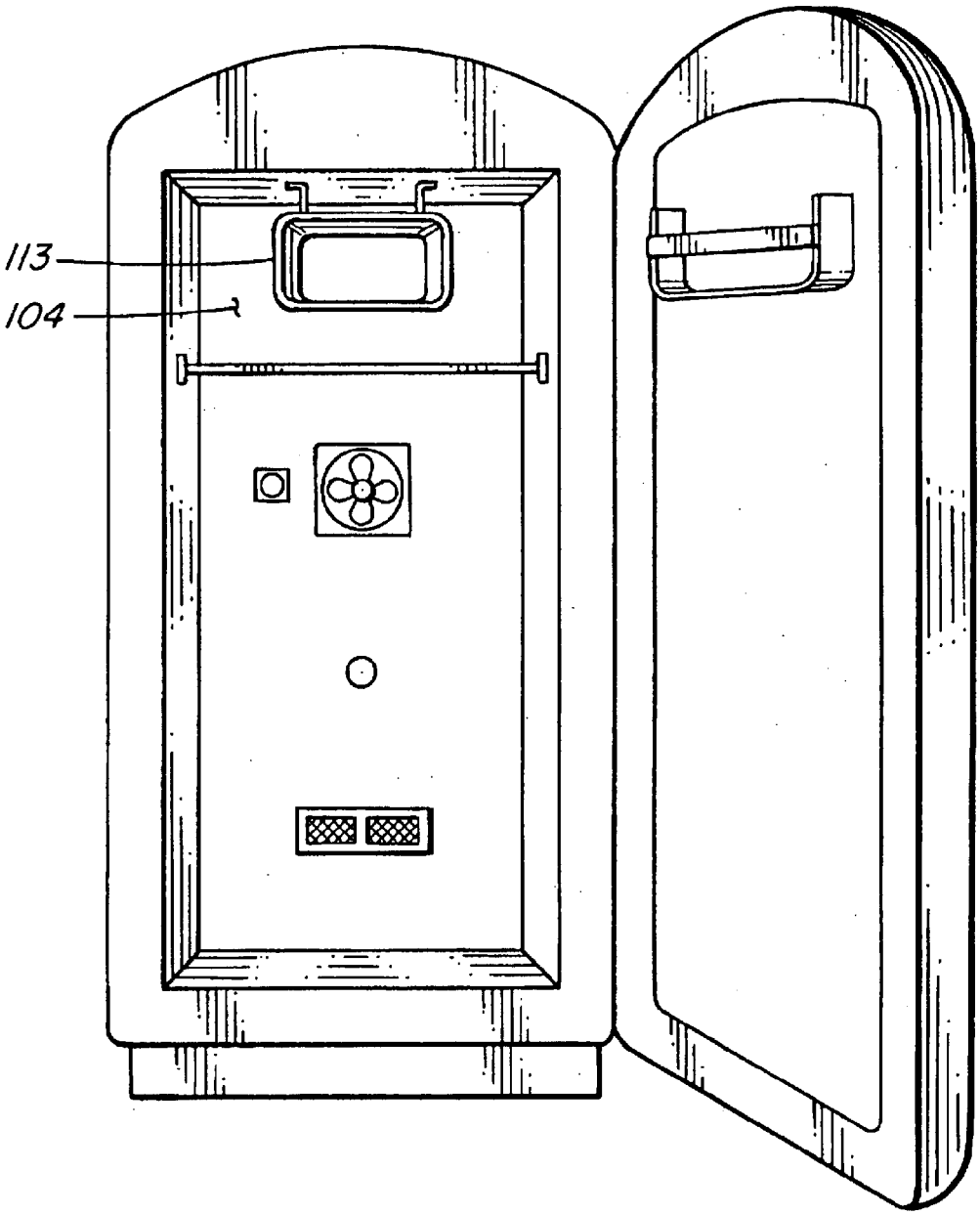
FIGS. 4A and 4B are front and back diagrammatic views of a discarded refrigerator of the older type and of the components on the back of such refrigerators, respectively, that must be removed in order to achieve the benefits of the invention.
Figure 4B:
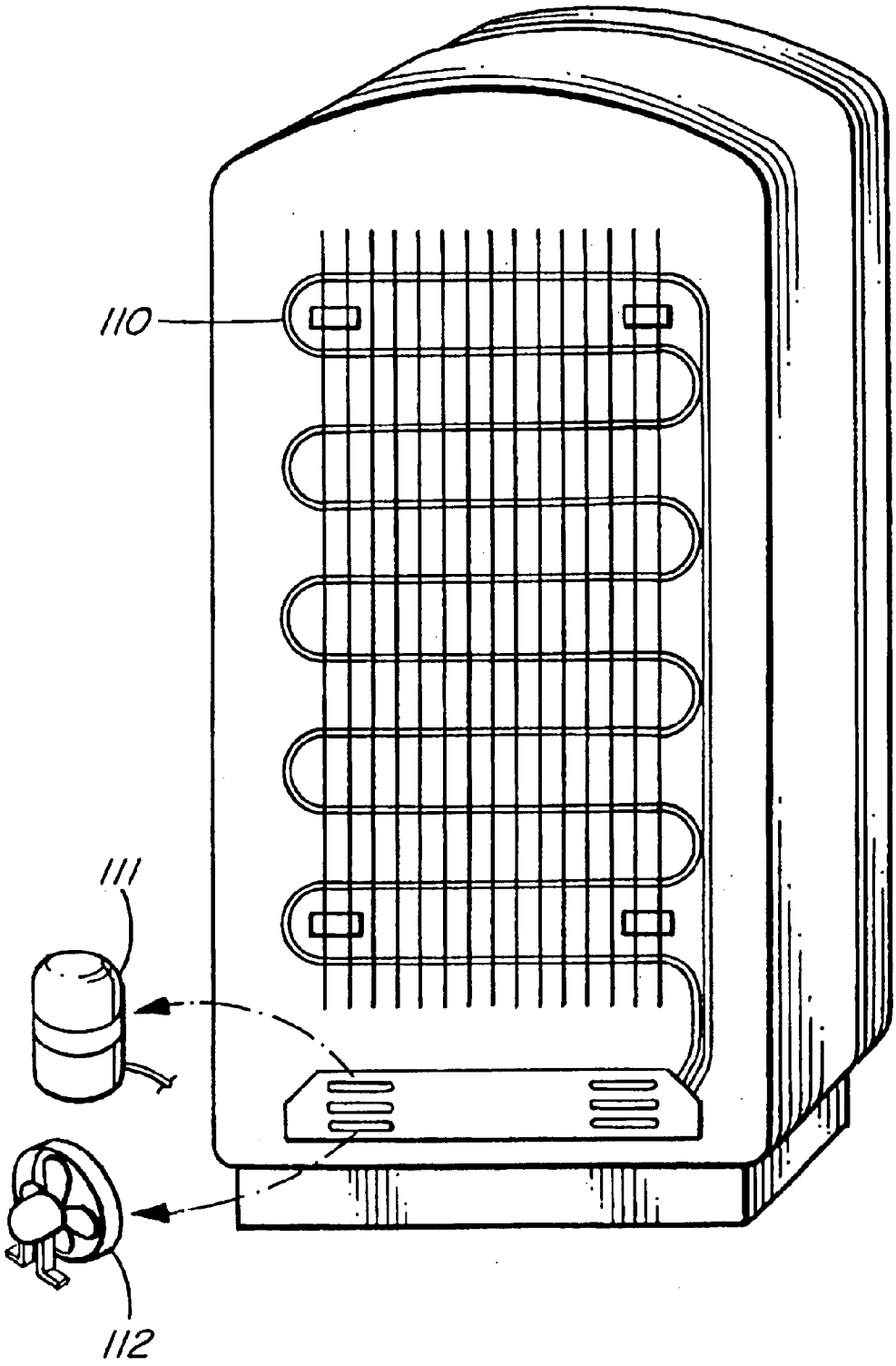

Various of the components of the refrigerator 100 which have been previously used are removed and otherwise discarded. The condenser grill 110 (FIG. 4B) and the compressor 111 will be removed and the coolant within the condenser and compressor circuit will also be removed with appropriate precautions taken for proper disposal. The condenser fan 112 will likewise be removed. If there is an icebox mounted within the main refrigerator area such as that ice box 113 seen in FIG. 4A which were commonly used in older type refrigerators, the icebox 113 will also conveniently be removed as well to open up additional storage.

Figure 3:
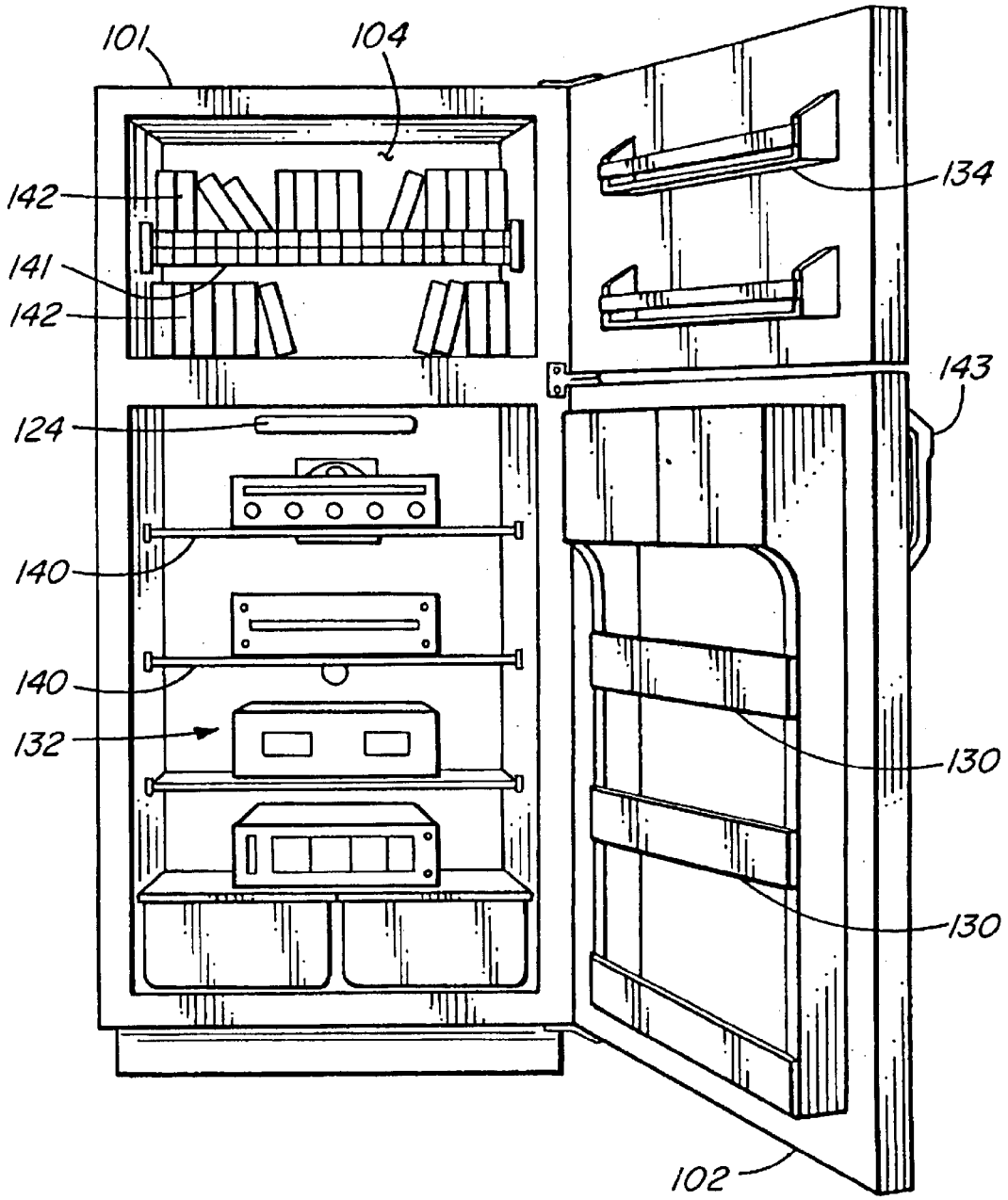
FIG. 3 is a diagrammatic isometric front view of the refrigerator similar to FIGS. 1 and 2 but illustrating the electronic music playing equipment located within the refrigerator.

Enhancements are then added to the stripped refrigerator 100 as seen in FIG. 1. A shelf 114 is conveniently added to the icebox 104. An exhaust fan 120 is conveniently added to the back of the refrigerator storage unit 103 to provide for egress of heat produced by the electronic components 132 (FIG. 3). An AC power exit hole 121 is likewise constructed in the rear of the refrigerator storage unit 103 to allow for passage of power and speaker cables (not illustrated) and the like and an intake vent 122 is also constructed in the rear of the refrigerator storage unit 103 to allow for ingress of cool air used for cooling the electronic components 132 during the operation of same. A rheostat 123 is also conveniently added so as to allow the speed of the fan 120 to be increased or decreased depending on the quantity of heat produced by the electronic components during operation, it being appreciated that the door 102 of the refrigerator 100 may and ordinarily will be closed during operation. The rheostat 123 is useful to reduce the speed and therefore the noise generated by the exhaust fan 120 depending on the volume of the music being played. If the volume of the music is low, the fan speed is decreased so that it will not be audible. This is a low cost and efficient technique. However, expensive fans are available that operate at very low decibels so that a manual or automatic rheostat 123 may not be necessary if expense is of no concern. In addition, the power generated during high volume operation will generally increase the temperature of the electronic components necessitating additional cooling. A temperature sensor (not illustrated) associated with the rheostat 123 can conveniently be used to increase the speed of the fan at high temperatures during higher volume and to decrease the speed of the fan at low volumes. An overhead light 124 is conveniently also added and is triggered on or off by the opening and closing of the refrigerator door 100, respectively.

There generally are crisper drawers 130 in the previously discarded refrigerator 100, two(2) such drawers 130 being shown in FIG. 1. The crisper drawers 130 are conveniently left as in their original configuration since they remain useful for storing electrical components and other equipment normally used during music playing. Likewise, the door shelves 130 may or may not remain in place on the door 102.

On the one hand, the shelves 130 may be of a size that is useful for the storage of cassettes and compact discs(CD's), video cassette recorders (VCR's) and like media. On the other hand, the door shelves 130 may protrude into the refrigerator storage unit 103 and interfere with the electronic equipment 132 (FIG. 3).

Figure 2:
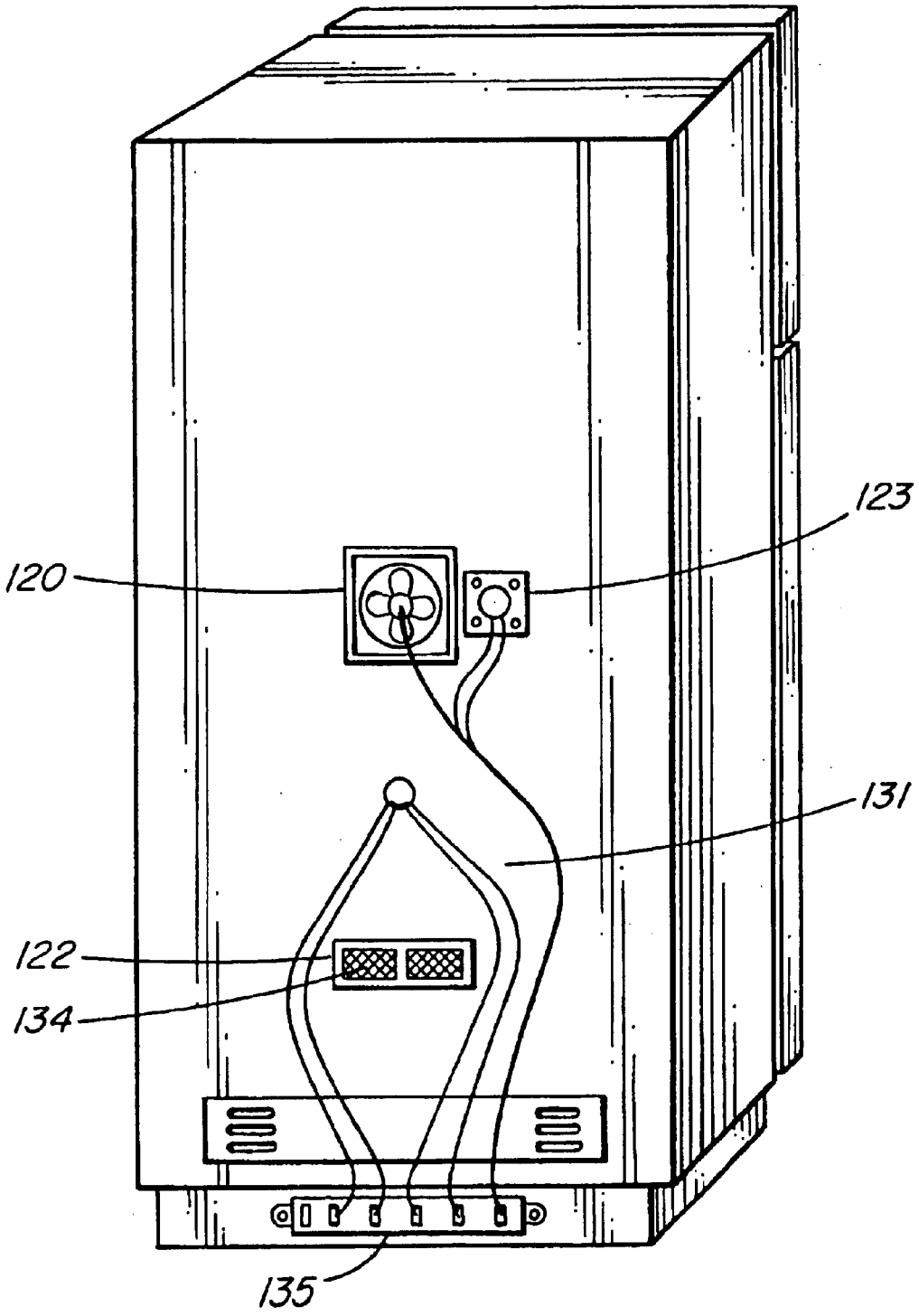
FIG. 2 is a diagrammatic rear isometric view of the refrigerator of FIG. 1 generally illustrating the added components needed to utilise a discarded refrigerator for the operation of a music player positioned within the refrigerator.

Referring now to FIG. 2, the mounting of the various components from a rear view of the refrigerator 100 is seen in greater detail. The exhaust fan 120 and the rheostat 123 to limit the noise of the fan 120 and to increase or decrease its speed are illustrated. The exit hole 121 is illustrated with the power and speaker cables generally illustrated at 131 passing there through and extending from the stereo components generally illustrated at 132 (FIG. 3) to a power strip 133 mounted on the lower back of the refrigerator 100. It will further be noted that the intake vent 122 may conveniently also include a dust filter 134 to clean the air entering into the refrigerator 100 during operation of the electronic components 132.

Reference is now made to FIG. 3 which illustrates the refrigerator 100 fully constructed and generally ready for operation. In this embodiment the door shelves 130 have been left in place and the stereo components 132 have been positioned within the refrigerator 100, one shelf 140 being used for each component and with a single shelf 141 added to the icebox 104 to hold the music and/or video media generally illustrated at 142.

OPERATION

In operation, an appropriate refrigerator 100 conveniently a discarded refrigerator or one not is use, will be located and the previously used components will be discarded or otherwise properly removed from the refrigerator 100. The openings for the exhaust fan 120, the AC power exit hold 121 and the air intake vent 122 will be added. The fan 120, the rheostat 123 and the air intake grill 122 with filter 134 as well as power strip 135 will be added. Shelves 140, 141 will be added to the storage unit 103 and to the icebox 104. The refrigerator 100 is now ready for the addition of the electronic components 132, music and video media 142 and other utility items with the power and speaker cables extending out the back of the refrigerator 100 by way of AC power exit hole 121.

It may and usually is be desired to close the door 102 of the refrigerator 100 and, if so, a lock 143 may be added to the door 102 which lock is useful to prevent theft of the electronic components when not in use since it is difficult to open the lock and the weight of the refrigerator 100 generally dictates difficulty in removal. The light 124 is usefully initiated by opening the door 102 of the refrigerator 100 when desired so as to better observe the items within the refrigerator 100.

Of course, the refrigerator 100 may be used for video operations and for holding other electronic components as well as music equipment and/or video playing equipment.

Many further modifications will readily occur to those skilled in the art to which the invention relates. Accordingly, it will be appreciated that the specific embodiments described herein are to be taken as illustrative of the invention only and not as limiting its scope as defined in accordance with the accompanying claims.

I claim:

1. A refrigerator having a door operable to open and close, a storage area for holding and allowing the operation of music playing electronic apparatuses and a fan operable to cool said musical playing electronic apparatuses during said operation.

2. A refrigerator as in claim 1 and further comprising a temperature regulating device within said storage area.

3. A refrigerator as in claim 2 wherein said temperature regulating device is a rheostat.

4. A refrigerator as in claim 3 wherein said rheostat is operably connected to said fan.

5. A refrigerator as in claim 4 wherein said rheostat is operable to increase and decrease the speed of said fan.

6. A refrigerator as in claim 5 wherein said rheostat increases the speed of said fan when said temperature within said refrigerator is higher.

7. A refrigerator as in claim 6 wherein said rheostat decreases the speed of said fan when said temperature within said refrigerator is lower.

8. A refrigerator as in claim 7 wherein said temperature within said storage area is dependent upon the volume of music played by said electronic apparatuses.

9. A refrigerator as in claim 7 wherein said rheostat is manually adjusted depending upon the volume of music from said electronic apparatuses.

10. A refrigerator as in claim 2 and further comprising a lock for said door.

11. Method of playing music from an electronic music player within a refrigerator having a door operable to be opened and closed, said method comprising initiating operation of said electronic music player within said refrigerator and cooling said electronic music player during said operation of said electronic music player within said refrigerator.

12. Method as in claim 11 and further comprising cooling said electronic music player with a fan during said operation.

13. Method as in claim 12 and further comprising controlling the speed of said fan.

14. Method as in claim 13 wherein said speed of said fan is controlled by a rheostat mounted within said refrigerator.

15. Method as in claim 14 and further comprising locking said door of said refrigerator with a lock.

16. Method as in claim 15 and further comprising storing media and music components within said refrigerator.

* * * * *